US008234723B2

(12) United States Patent
Allen

(10) Patent No.: US 8,234,723 B2
(45) Date of Patent: Aug. 7, 2012

(54) METHOD AND APPARATUS FOR DELIVERING A URINAL CLEANSER AND TRAP SEALANT

(75) Inventor: James C. Allen, Chicago, IL (US)

(73) Assignee: Sloan Valve Company, Franklin Park, IL (US)

( * ) Notice: Subject to any disclaimer, the term of this patent is extended or adjusted under 35 U.S.C. 154(b) by 1334 days.

(21) Appl. No.: 11/871,295

(22) Filed: Oct. 12, 2007

(65) Prior Publication Data

US 2008/0256695 A1 Oct. 23, 2008

Related U.S. Application Data

(60) Provisional application No. 60/829,437, filed on Oct. 13, 2006.

(51) Int. Cl.
*E03D 13/00* (2006.01)

(52) U.S. Cl. ..... 4/309

(58) Field of Classification Search ..... 4/309
See application file for complete search history.

(56) References Cited

U.S. PATENT DOCUMENTS

| | | | | |
|---|---|---|---|---|
| 3,934,275 | A | 1/1976 | Bishton, Jr. | |
| 4,028,747 | A | 6/1977 | Newton | |
| 4,050,102 | A * | 9/1977 | Kemper et al. | 4/317 |
| 4,244,061 | A | 1/1981 | Webster et al. | |
| 5,235,706 | A * | 8/1993 | Allen et al. | 4/302 |
| 5,269,028 | A | 12/1993 | Liao | |
| 5,711,037 | A | 1/1998 | Reichardt et al. | |
| 5,965,514 | A | 10/1999 | Wierenga et al. | |
| 6,286,153 | B1 | 9/2001 | Keller | |
| 6,487,731 | B1 | 12/2002 | Houde | |
| 6,560,790 | B2 | 5/2003 | Saar et al. | |
| 6,589,440 | B2 | 7/2003 | Atwill | |
| 6,701,541 | B2 | 3/2004 | Romagna et al. | |
| 2002/0038474 | A1 | 4/2002 | Atwill | |
| 2002/0069913 | A1 | 6/2002 | Gorges et al. | |
| 2002/0120981 | A1 | 9/2002 | Gorges | |
| 2002/0166162 | A1 | 11/2002 | Romagna et al. | |
| 2003/0089397 | A1 | 5/2003 | Gorges | |
| 2006/0198812 | A1 * | 9/2006 | Pliszka | 424/76.2 |
| 2006/0207005 | A1 * | 9/2006 | Janssen | 4/310 |
| 2008/0216222 | A1 * | 9/2008 | Farber et al. | 4/305 |

* cited by examiner

*Primary Examiner* — Lori Baker
(74) *Attorney, Agent, or Firm* — Cook Alex Ltd.

(57) ABSTRACT

A waterless urinal has a fixture including a backsplash and side walls joining a bowl at the bottom. Mounted on the top of the fixture is a fluid reservoir, a valve and a controller. The controller periodically opens the valve to release a quantity of a cleansing sealant from the reservoir onto the non-wetted surfaces of the fixture. The cleansing sealant cleans the non-wetted surfaces and then flows into the bowl where it collects to replenish the trap seal.

11 Claims, 2 Drawing Sheets

METHOD AND APPARATUS FOR DELIVERING A URINAL CLEANSER AND TRAP SEALANT

CROSS REFERENCE TO RELATED APPLICATION

This application claims the benefit of U.S. provisional application No. 60/829,437, filed Oct. 13, 2006.

BACKGROUND OF THE INVENTION

The continuing need to conserve water resources has lead to increasing pressure on manufacturers of sanitary ware to reduce the amount of water used by these devices. This in turn has lead to the development and increasing deployment of so-called waterless or water-free urinals. These fixtures typically have a vertical wall or backsplash joined to side walls. The interior surfaces of these walls will be referred to herein as the non-wetted surfaces of the urinal. While the backsplash and side walls do get wet during use, they are not permanently bathed in fluid and they have the potential to dry off, thus the term non-wetted surfaces. The backsplash and side walls converge at the bottom of the urinal to form a bowl. A drain or sewer pipe is connected to an opening in the bowl. The interior of the bowl defines a well which retains a quantity of liquid therein covering the drain pipe to prevent escape of gases from the drain pipe. A trap or cartridge is typically disposed in the bowl. The trap defines a circuitous path for liquids to pass through the bowl, eventually overflowing a trap opening into the drain or sewer pipe.

A trap sealant fluid having a specific gravity lesser than that of urine is provided in the well where it resides on top of a charge of water or a water/urine mixture. The trap sealant prevents exposure of the urine to the ambient air, thereby preventing formation of foul odors from the urinal. The trap sealant is a fluid that does not readily mix with urine but instead floats on top and permits urine to flow through it and into the passages of the trap. The interior portions of the bowl that are permanently in contact with the urine and sealant will be referred to herein as the wetted surfaces because in normal operation they are always in contact with fluid and are never permitted to dry off.

Examples of the general structure of a waterless urinal as just described are shown in U.S. Pat. Nos. 6,701,541, 6,589,440 and 6,286,153.

One of the problems with existing waterless urinals is they require a relatively high level of maintenance to replenish the trap sealant and clean the non-wetted surfaces. While the sealant in general does not mix with urine and floats on top of it in the well, the natural turbulence of flow when urine enters the well will entrain small amounts of the sealant with the urine and carry it into the drain. Thus, the level of sealant gradually diminishes. Manual replenishment of the sealant is required for the prior art waterless urinals to operate properly.

Another problem with prior art waterless urinals is in many operating environments the usage rate of the urinals is such that the backsplash and side walls eventually dry out. While the trap is designed such that much of the well portion of the urinal is covered by the sealant fluid, that is not the case for large portions of the fixture. Objectionable odors result from the alternating wetting and drying of the backsplash and side walls. Naturally these odors lead to complaints of unsanitary conditions. Of course, conventional water-flushed urinals avoid this problem by running water down the fixture at each flush cycle, or at least some of the flush cycles. Some water-flushed urinals have attempted to reduce their water consumption by reducing the number of backsplash rinse cycles or the amount of water used in each one. See U.S. Pat. Nos. 5,235,706 and 6,862,754. However, none of these efforts are adaptable to waterless urinals.

SUMMARY OF THE INVENTION

The present invention is directed to a method and apparatus for delivering a cleansing solution that also effectively seals the trap in a waterless urinal. A primary object of the invention is the cleansing of the urinal surfaces that are not permanently wetted and the replenishment of the sealant volume to assure proper operation of the wetted portion of the fixture.

A further object of the invention is a cleansing sealant dispenser that can be used with existing urinals without the need for retrofitting the fixture or changing a trap cartridge.

A still further object of the invention is a cleansing sealant dispenser that is mounted on the outside of the urinal, thereby facilitating servicing of the unit.

Yet another object of the invention is a waterless urinal that reduces the amount of maintenance needed to maintain sanitary operation.

These and other desired benefits of the invention, including combinations of features thereof, will become apparent from the following description. It will be understood, however, that a device could still appropriate the claimed invention without accomplishing each and every one of these desired benefits, including those gleaned from the following description. The appended claims, not these desired benefits, define the subject matter of the invention.

The present invention encompasses a method of simultaneously cleaning the non-wetted surfaces of a waterless urinal sealant and replenishing the sealant of the wetted surfaces. It also includes a dispenser mounted on or near the top of the urinal. The dispenser has a cleansing sealant reservoir connected in fluid communication with a valve which is opened by a controller to release a predetermined amount of a cleansing sealant onto the interior of the backsplash and side walls of a waterless urinal. The controller may include a sensor that detects use of the fixture and activates the valve in accordance with a schedule or program associated with user detection. The schedule or program need not necessarily cause valve opening upon each and every use of the fixture. Some other schedule, such as every other use or every third use, could be implemented as needed to clean the backsplash and side walls and maintain the sealant volume. Alternately, a release schedule based on time could be implemented.

DETAILED DESCRIPTION OF THE INVENTION

Figure 2:
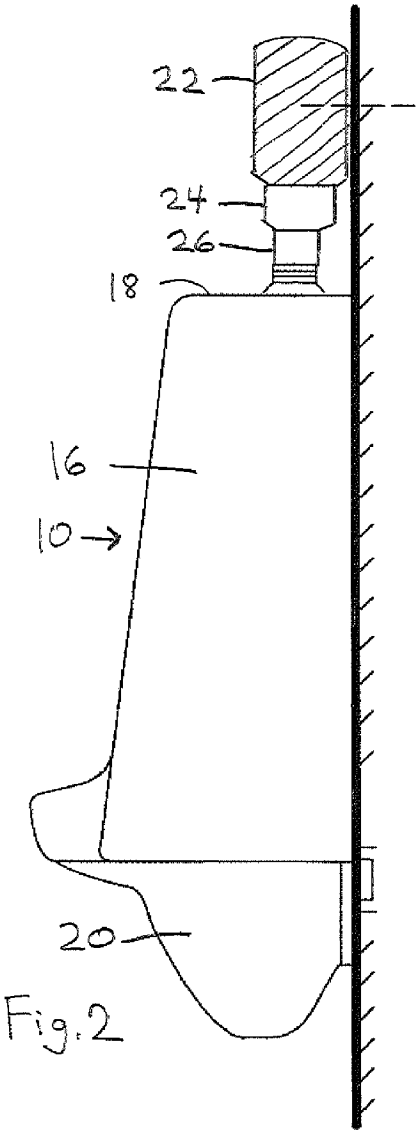
FIG. 2 is a side elevation view of the waterless urinal of FIG. 1.
Figure 1:
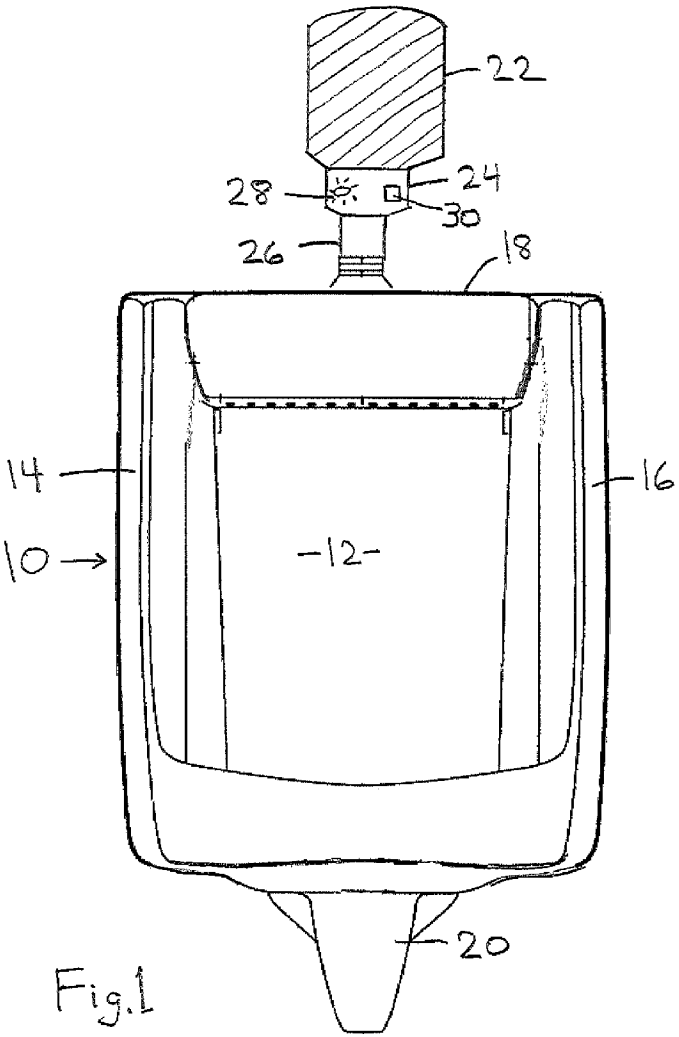
FIG. 1 is a front elevation view of a waterless urinal according to the present invention.
Figure 3:
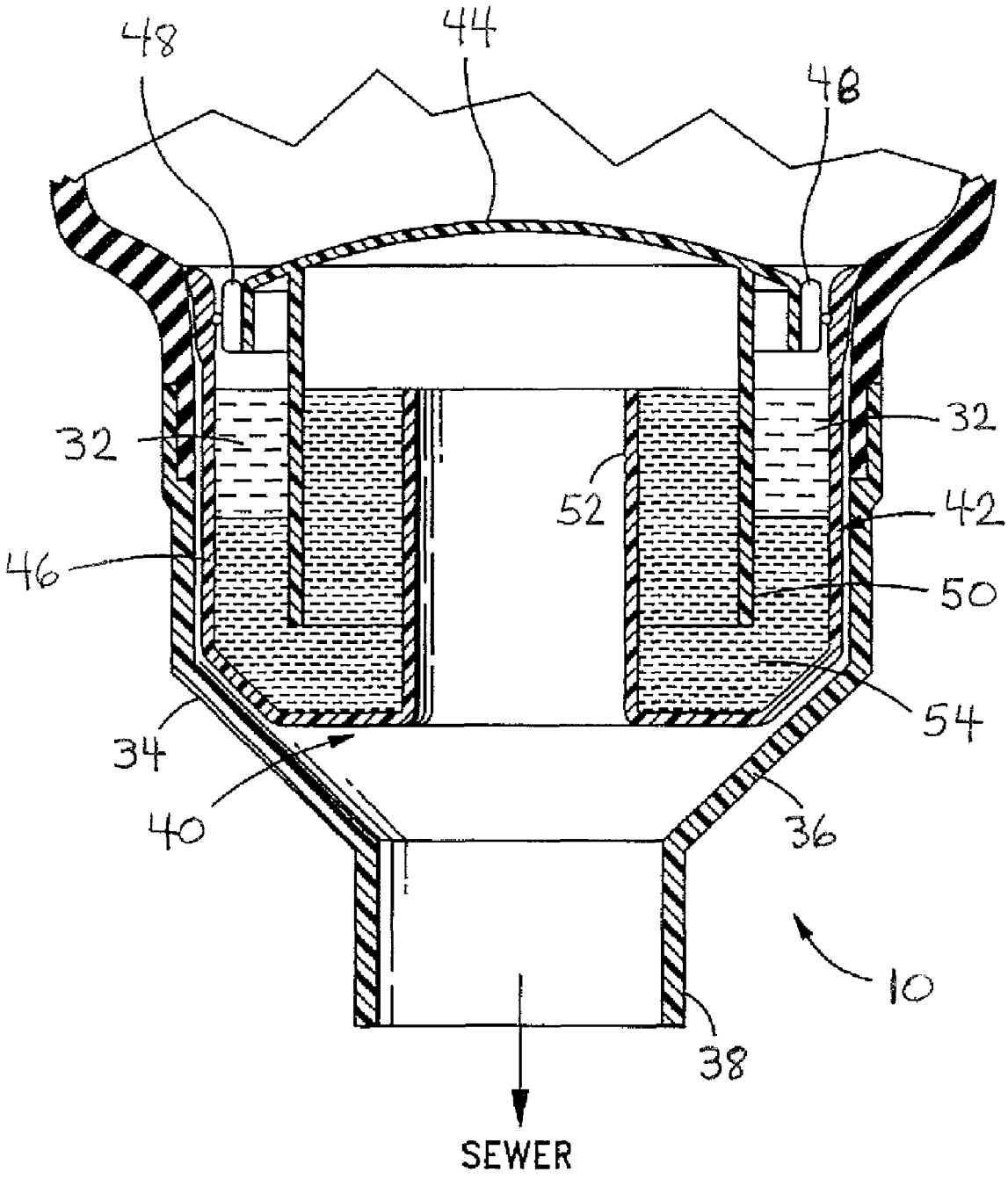
FIG. 3 is a cross-sectional view, on an enlarged scale, of a prior art trap in the bowl portion of a waterless urinal.

A urinal according to the present invention is shown generally at 10 in FIGS. 1 and 2. The urinal includes a fixture including a backsplash 12, side walls 14 and 16, and a top wall 18. At the bottom of the fixture the backsplash and side walls converge at a bowl 20. Inside the bowl there may be a trap. One possible example of a trap is shown in FIG. 3. Details of this particular trap will be described below. It will be understood that the details of the trap could be other than those shown. Similarly, the details of the fixture could be altered from the particular illustration.

In the present invention there is a cleansing sealant reservoir 22 mounted on the top wall 18 of the fixture. A valve and controller are indicated schematically at 24. The valve is in fluid communication with the reservoir. The valve is connected to a pipe 26 that connects to an opening in the top wall 18. That opening is connected to a plurality of passages in the interior of the fixture. These internal passages are arranged such that fluid released from the reservoir will flow down the non-wetted portions of the fixture. That is, cleansing sealant fluid from the reservoir 22 will form a sheet that washes over the interior surfaces of the backsplash 12 and side walls 14, 16. The controller 24 may include a low level indicator 28 and a primer button 30.

The controller 24 operates on a schedule or program that periodically opens the valve for a selected duration and allows flow from the cleansing sealant reservoir 22. Preferably the controller schedule or program is dependent on usage of the fixture. In this case the controller 24 will preferably include a detector which detects the presence of a user of the urinal. The detector could be as shown in the aforementioned U.S. Pat. No. 5,235,706, the disclosure of which is incorporated herein by reference. The program may then call for opening the valve after a certain number of uses, whether that be one, two or more uses. This may be selectively programmed into the controller 24 depending on the expected usage of the fixture. In other words, experience may show in some environments a release of cleansing sealant is necessary after every use while in other environments less frequent releases of cleansing sealant are adequate. Alternately, the release schedule may not be tied to usage at all, but rather to the passage of time or some other criterion. What is important is that the controller 24 be programmed to release sufficient cleansing sealant to maintain a proper seal in the bowl and to clean the non-wetted surfaces often enough to prevent formation of foul odors.

For purposes of illustrating a typical trap in the urinal bowl and how a sealant is arranged, FIG. 3 shows a known trap suitable for a waterless urinal. It will be understood that the specific arrangement of the trap could be other than as shown, so long as it includes a liquid sealant floating on top of another liquid. In FIG. 3 the waterless urinal 10 uses the sealing liquid 32 as discussed below. The urinal 10 includes a bowl 34 with a tapered lower portion 36 that has an outlet tube 38 extending therefrom. The outlet tube 38 is connected to a sewer. There is a well 40 in the interior of the bowl 34. A removable cartridge shown generally at 42 is placed in the well 40. The cartridge includes a cap 44 resting on the upper, open end of a lower compartment 46. The cap 44 has a plurality of openings 48 around its periphery. A cylindrical partition wall 50 projects downwardly from the underside of the cap 44 into the lower compartment 46. A stand pipe 52 projects upwardly from the bottom of the lower compartment 46 into the cylindrical partition wall 50. The cleansing sealant 32 forms an annular layer about ⅛ to 1 inch in thickness that floats on top of an initial charge of water 54 or, as the urinal 10 is used, collected urine, or a mixture of water and urine. The cleansing sealant is located only on the exterior of the partition wall 50. Together the lower compartment 46, the partition wall 50 and the standpipe 52 define a labyrinthine path from the non-wetted surfaces of the urinal to the sewer line.

When the urinal is used urine flows down the backsplash and/or side walls and through the openings 48. When the urine encounters the cleansing sealant layer it will flow through the layer, because the urine is heavier than the cleansing sealant 32, and into the charge layer 54. As the overall liquid level increases, the charge layer inside the partition wall 50 overflows the standpipe 52 and into the outlet tube 38 and thence to the sewer. Due to the turbulence of the flow through the cleansing sealant layer 32, droplets of the cleansing sealant will become entrained in the urine and will be carried into the interior of the partition wall 50. From there it gets washed into the drain with the charge layer liquid 54. This explains why the cleansing sealant 32 has to be replenished from time to time.

The cleansing sealant used with the present invention is a lactic acid with a surfactant. This fluid serves as both a cleanser of the non-wetted surfaces of the fixture and as a sealant of the trap. It has a specific gravity less that water so it will float on top of any liquid in the bowl. A fragrance may be added to the cleansing sealant to create a pleasant aroma.

Among the advantages of the waterless urinal of the present invention are the cleansing sealant reservoir 22 is outside the urinal fixture. Most cleaning devices for urinals are inside the urinal which complicates maintenance of these devices. With the external reservoir it is much easier to refill the reservoir and check for proper operation of the controller and valve unit 24.

It will be understood that the cleansing sealant reservoir 22 and the controller and valve unit 24 could be used existing waterless urinals having a conventional sealant therein. The cleansing sealant proposed for use with the present invention is compatible with conventional sealants and does not dilute or otherwise diminish their intended function.

While the preferred form of the invention has been shown and described herein, it should be realized that there may be many modifications, substitutions and alterations could be made thereto without departing from the scope of the following claims. For example, while it is preferred to have a cleansing sealant dispensed by a single valve from a single reservoir, it would be possible to have a cleansing liquid in one reservoir and a sealing liquid in a second, separate reservoir, each reservoir having its own valve. This would make it possible to clean the non-wetted surfaces on a different schedule than replenishment of the sealant layer.

I claim:

1. A method of operating a waterless urinal having a fluid-containing bowl, a valve-less cartridge positioned within the bowl, and non-wetted surfaces, the method including the steps of:

mounting a reservoir for a cleansing sealant in fluid communication with the urinal;

periodically releasing a selected amount of a cleansing sealant from the reservoir onto the non-wetted surfaces of the urinal; and collecting and retaining the cleansing sealant in the bowl of the urinal where it seals the fluid contained in the bowl.

2. The method of claim 1 further comprising the step of detecting use of the urinal and releasing the cleansing sealant in accordance with a schedule dependent on usage of the urinal.

3. The method of claim 1 further comprising the step of releasing the cleansing sealant in accordance with a schedule dependent on time.

4. The method of claim 1 wherein the mounting step is further characterized by mounting the reservoir on the exterior of the urinal.

5. A method of operating a waterless urinal having a fluid-containing bowl, a valve-less cartridge positioned within the bowl, and non-wetted surfaces, the method including the steps of:

mounting a reservoir for a sealant in fluid communication with the urinal;

periodically releasing a selected amount of a sealant from the reservoir into the urinal; and collecting the sealant in the valve-less cartridge in the bowl of the urinal where it seals the fluid contained in the bowl.

6. The method of claim 5 further comprising the step of detecting use of the urinal and releasing the sealant in accordance with a schedule dependent on usage of the urinal.

7. The method of claim 5 further comprising the step of releasing the sealant in accordance with a schedule dependent on time.

8. The method of claim 5 wherein the mounting step is further characterized by mounting the reservoir on the exterior of the urinal.

9. A waterless urinal, comprising a fixture having a backsplash and a bowl receiving a valve-less cartridge, a reservoir for containing a sealant mounted in fluid communication with the fixture, a valve in fluid communication with the reservoir and the fixture, and a controller for opening and closing the valve to release a predetermined amount of sealant into the urinal, where the predetermined amount of sealant is retained in the cartridge.

10. The waterless urinal of claim 9 further characterized in that the reservoir is mounted near the top of the fixture.

11. The waterless urinal of claim 10 further characterized in that the reservoir is arranged to release sealant onto the backsplash.

* * * * *